US008864059B2

(12) United States Patent
Hatada et al.

(10) Patent No.: US 8,864,059 B2
(45) Date of Patent: Oct. 21, 2014

(54) PRINTING DEVICE AND ROLL DIAMETER CALCULATING METHOD AND PROGRAM

(75) Inventors: Kenji Hatada, Shiojiri (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 326 days.

(21) Appl. No.: 13/182,996

(22) Filed: Jul. 14, 2011

(65) Prior Publication Data

US 2012/0012634 A1 Jan. 19, 2012

(30) Foreign Application Priority Data

Jul. 15, 2010 (JP) ..... 2010-160935

(51) Int. Cl.
*B65H 23/16* (2006.01)
*B65H 19/10* (2006.01)

(52) U.S. Cl.
CPC ..... *B65H 19/10* (2013.01); *B65H 2515/704* (2013.01); *B65H 2403/942* (2013.01); *B65H 2511/21* (2013.01); *B65H 2801/12* (2013.01); *B65H 2511/142* (2013.01); *B65H 2511/22* (2013.01); *B65H 2557/24* (2013.01)
USPC ..... 242/419.2; 242/421.2; 242/534.2

(58) Field of Classification Search
USPC ..... 242/419.2, 420.5, 421.2, 534.2, 563.2, 242/564.4
See application file for complete search history.

(56) References Cited

U.S. PATENT DOCUMENTS 1,739,116 A * 12/1929 Ball et al. ..... 242/563
2,618,441 A * 11/1952 Marcellus ..... 242/419.2
2,874,916 A * 2/1959 Wallin ..... 242/420.5
3,485,167 A * 12/1969 Massey et al. ..... 101/260
3,561,691 A * 2/1971 Nichols et al. ..... 242/418.1
3,910,521 A * 10/1975 O'Callaghan et al. ..... 242/413.9
4,238,082 A * 12/1980 Lund ..... 242/412.1
4,961,658 A * 10/1990 Takagi ..... 400/636.1
5,092,690 A * 3/1992 Grimm et al. ..... 347/104
5,464,167 A * 11/1995 Fujisawa et al. ..... 242/334
5,727,724 A * 3/1998 Dowling ..... 226/181
5,967,445 A * 10/1999 Yuyama et al. ..... 242/421.1

(Continued)

FOREIGN PATENT DOCUMENTS

JP 06-156841 A 6/1994
JP 2000-255858 A 9/2000

(Continued)

*Primary Examiner* — Emmanuel M Marcelo
*Assistant Examiner* — Michael Gallion
(74) *Attorney, Agent, or Firm* — Nutter McClennen & Fish LLP; John J. Penny, Jr.; Michael P. Visconti, III

(57) ABSTRACT

A printing device includes a first roller for rotatably retaining a roll body where a medium is rolled, a first motor for rotating the first roller, a second roller installed further to the downstream side of the roll body in the feeding direction of the medium to feed the medium in the feeding direction or in a reverse feeding direction which is opposite to the feeding direction corresponding to the rotating direction, a second motor for rotating the second roller, and a controller which causes the medium to become slack the first roller and the second roller by feeding the medium by a predetermined feeding amount in the reverse feeding direction by the second motor, and then rotates the roll body in a winding-up direction by the first motor so that the slackness decreases to calculate the diameter of the roll body based on the rotation amount of the first roller at that time and the predetermined feeding amount.

5 Claims, 5 Drawing Sheets

(56) References Cited

U.S. PATENT DOCUMENTS

| | | | | |
|---|---|---|---|---|
| 6,068,209 | A * | 5/2000 | Nakamura | 242/421.2 |
| 6,196,493 | B1 * | 3/2001 | Tanaka | 242/564.4 |
| 6,254,228 | B1 * | 7/2001 | Sago | 347/88 |
| 6,345,782 | B1 * | 2/2002 | Nakayama et al. | 242/564.4 |
| 6,372,065 | B1 | 4/2002 | Tabuchi et al. | |
| 6,433,499 | B1 * | 8/2002 | Cote et al. | 318/432 |
| 6,742,862 | B2 * | 6/2004 | Yamada et al. | 347/30 |
| 7,564,205 | B2 * | 7/2009 | Sugimoto | 318/400.01 |
| 7,617,773 | B2 * | 11/2009 | Schroeder et al. | 101/484 |
| 8,002,214 | B2 * | 8/2011 | Genta et al. | 242/420.6 |
| 8,087,670 | B2 * | 1/2012 | Noguchi et al. | 271/270 |
| 8,256,334 | B2 * | 9/2012 | Lin | 83/522.14 |
| 2003/0156344 | A1 * | 8/2003 | Chliwnyj et al. | 360/71 |
| 2004/0108155 | A1 * | 6/2004 | Mori et al. | 180/268 |
| 2005/0022946 | A1 * | 2/2005 | Domel | 160/168.1 P |
| 2006/0033804 | A1 * | 2/2006 | Dan | 347/230 |
| 2008/0019757 | A1 * | 1/2008 | Watanabe | 400/648 |
| 2008/0239052 | A1 * | 10/2008 | Ishii et al. | 347/104 |
| 2009/0057997 | A1 * | 3/2009 | Hatada et al. | 271/270 |
| 2009/0212491 | A1 * | 8/2009 | Noguchi et al. | 271/265.04 |
| 2009/0245912 | A1 * | 10/2009 | Igarashi et al. | 400/618 |
| 2009/0297244 | A1 | 12/2009 | Hatada et al. | |
| 2010/0332872 | A1 * | 12/2010 | Hanson et al. | 713/320 |
| 2011/0242245 | A1 * | 10/2011 | Okazaki | 347/104 |

FOREIGN PATENT DOCUMENTS

| | | | |
|---|---|---|---|
| JP | 2006008322 | A * | 1/2006 |
| JP | 2006-225127 | A | 8/2006 |
| JP | 2009-208921 | A | 9/2009 |
| JP | 2009-255496 | A | 11/2009 |
| JP | 2009-263044 | A | 11/2009 |
| JP | 2009-280364 | A | 12/2009 |

* cited by examiner

PRINTING DEVICE AND ROLL DIAMETER CALCULATING METHOD AND PROGRAM

BACKGROUND

1. Technical Field

The present invention relates to a printing device and a roll diameter calculating method and program.

2. Related Art

Among printing devices, for example ink jet printers, there is a type which uses a large-sized paper with a paper size of A2 or above. The ink jet printer using such a large-sized paper mainly uses a so-called roll paper in addition to a cut paper. In addition, hereinafter, a so-called roll paper obtained by winding-up a paper is called a roll body, and a portion drawn out from the roll body is called a paper.

The paper is drawn out from the roll body by rotating a feeding roller by means of a paper feeding motor (a PF motor).

In addition, there is proposed a printer in which a motor (a roll motor) for rotating a roll body is provided to operate two motors so that the tension of the paper is controlled between the roll body and the feeding roller (for example, see JP-A-2009-263044).

As a paper is drawn out from the roll body, the diameter and weight of the roll body vary. Along with the variation of the diameter and weight of the roll body, the tension of the paper between the roll body and the feeding roller pair rotated by the PF motor greatly fluctuates. In other words, in order to improve precision of the tension control, it is necessary to correctly check the diameter of the roll body.

SUMMARY

Therefore, an advantage of some aspects of the invention is to precisely calculate the diameter of a roll body with a simple configuration.

According to an aspect of the invention, there is provided a printing device including a first roller that rotatably retains a roll body where a medium is rolled, a first motor that rotates the first roller, a second roller that is installed further to the downstream side of the roll body in the feeding direction of the medium to feed the medium in the feeding direction or in a reverse feeding direction which is opposite to the feeding direction corresponding to the rotating direction, a second motor that rotates the second roller, and a controller that causes the medium to become slack between the first roller and the second roller by feeding the medium by a predetermined feeding amount in the reverse feeding direction by the second motor, and then rotates the roll body in the winding-up direction by the first motor so that the slackness decreases to calculate the diameter of the roll body based on the rotation amount of the first roller at that time and the predetermined feeding amount.

Other features of the invention will be apparent from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
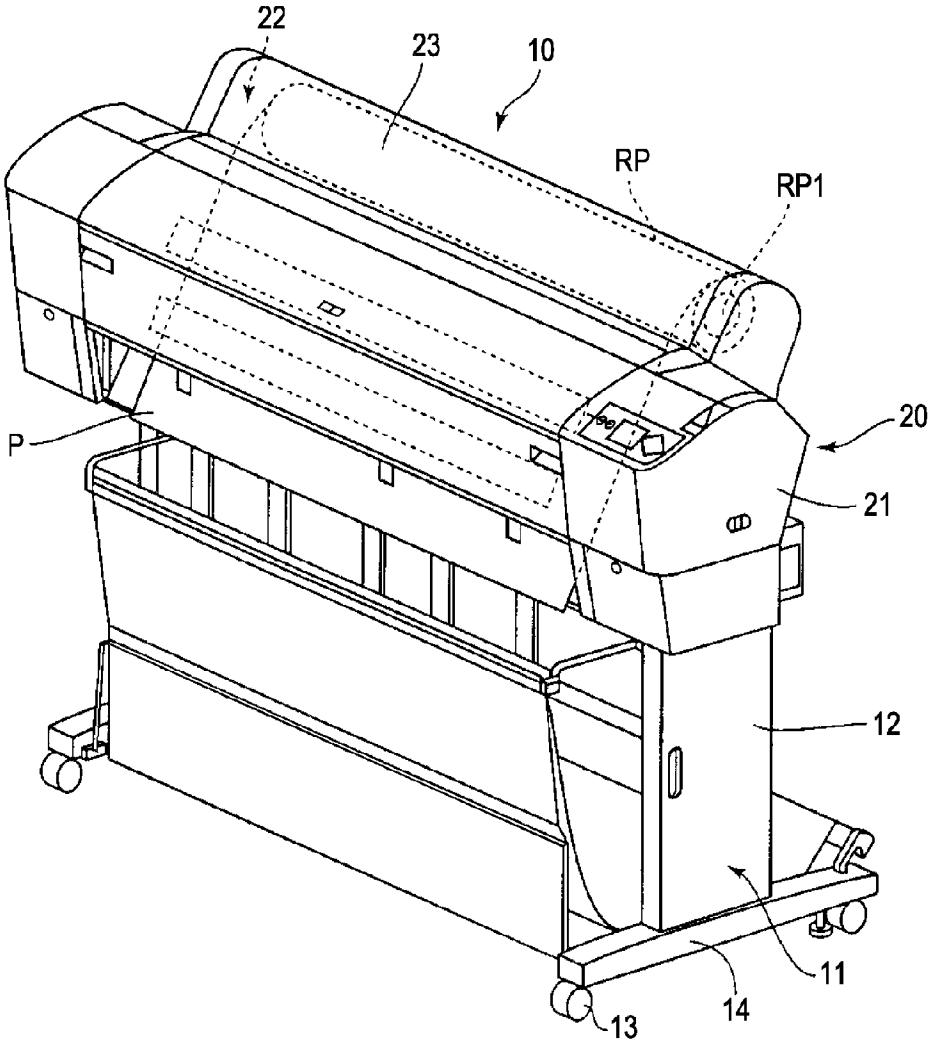
FIG. 1 shows an example of an appearance of a printer.

The following will become apparent at least by this specification and the accompanying drawings.

A printing device includes a first roller for rotatably retaining a roll body where a medium is rolled, a first motor for rotating the first roller, a second roller installed on the downstream side of the roll body in the feeding direction of the medium to feed the medium in the feeding direction or in a reverse feeding direction which is opposite to the feeding direction corresponding to the rotating direction, a second motor for rotating the second roller, and a controller which causes the medium to become slack the first roller and the second roller by feeding the medium by a predetermined feeding amount in the reverse feeding direction by the second motor, and then rotates the roll body in a winding-up direction by the first motor so that the slackness decreases to calculate the diameter of the roll body based on the rotation amount of the first roller at that time and the predetermined feeding amount.

By using this printing device, the diameter of the roll body may be precisely calculated with a simple configuration.

The printing device may further include a current measuring unit for measuring a current value flowing through the first motor, and the controller preferably determines that the slackness is resolved when the measured value of the current measuring unit becomes a predetermined current value.

By using this printing device, it may be exactly determined whether the slackness is resolved or not.

In the printing device, the controller preferably sets a current value flowing through the first motor to zero after the measured value of the current measuring unit becomes the predetermined current value.

By using this printing device, power consumption may be reduced.

In addition, as a roll diameter calculating method of a printing device which includes a first roller for rotatably retaining a roll body where a medium is rolled; a first motor for rotating the first roller; a second roller installed on the downstream side of the roll body in the feeding direction of the medium to feed the medium in the feeding direction or in a reverse feeding direction which is opposite to the feeding direction corresponding to the rotating direction; and a second motor for rotating the second roller, the method includes feeding the medium by a predetermined feeding amount in the reverse feeding direction by the second motor so that the medium becomes slack between the first roller and the second roller, rotating the roll body in a winding-up direction by the first motor so that the slackness decreases, and calculating the diameter of the roll body based on the rotation amount of the first roller and the predetermined feeding amount.

In addition, a program causes a controller of a printing device which includes a first roller for rotatably retaining a roll body where a medium is rolled; a first motor for rotating the first roller; a second roller installed further to the downstream side of the roll body in the feeding direction of the medium to feed the medium in the feeding direction or in a reverse feeding direction which is opposite to the feeding direction corresponding to the rotating direction; and a second motor for rotating the second roller, to execute the following functions: feeding the medium by a predetermined feeding amount in the reverse feeding direction by the second motor so that the medium becomes slack between the first roller and the second roller by feeding the medium, rotating the roll body in a winding-up direction by the first motor so that the slackness decreases, and calculating the diameter of the roll body based on the rotation amount of the first roller and the predetermined feeding amount.

Embodiment

Hereinafter, a printer 10 used as the printing device and an operation control method will be described. In addition, the printer 10 of this embodiment is a printer for printing a large sized paper (for example, a size of A2 or above in the JIS standards). Moreover, the printer of this embodiment is an ink jet printer, but the ink jet printer may employ any ejection method. Further, the invention is not limited to an ink jet printer, but any device for performing printing on a paper drawn out from a roll body by using the roll body may be used.

In addition, in the following description, the lower side indicates the side to which the printer 10 is installed, and the upper side indicates a side spaced apart from the installation side. Further, the side where a paper P is fed is called the feeding side (the rear end side), and a side where the paper P is discharged is called a discharging side (the front side).

Configuration of the Print

Figure 2:
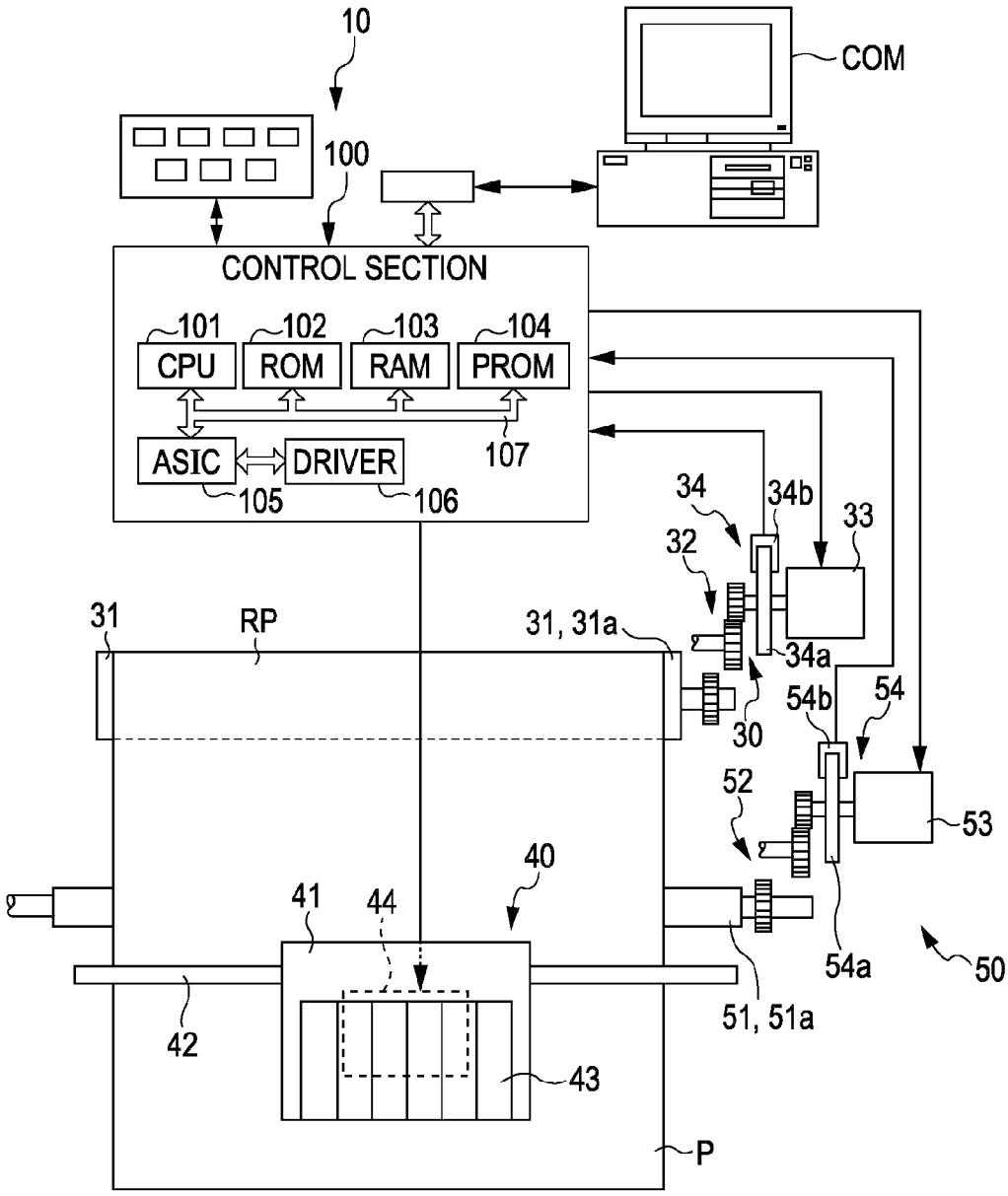
FIG. 2 shows a relation between a control system and an operation system using a DC motor of a printer.
Figure 3:
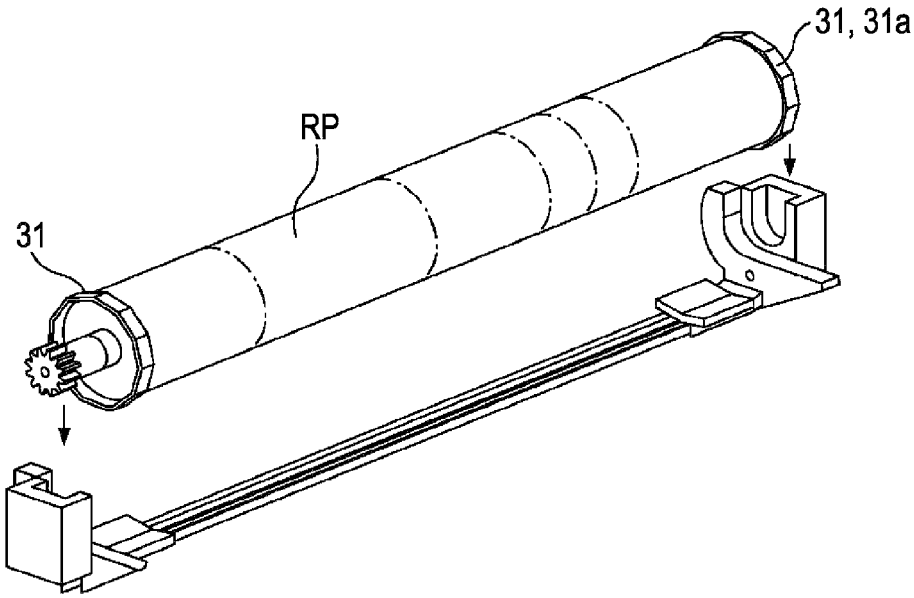
FIG. 3 shows a roll body which is loaded.

FIG. 1 shows an example of an appearance of the printer 10 according to this embodiment. FIG. 2 shows a relation between a control system and an operating system using a DC motor in the printer 10 of FIG. 1. FIG. 3 shows a roll body RP which is loaded.

In this example, the printer 10 includes a pair of legs 11 and a main body 20 supported by the legs 11. To the legs 11, a strut 12 is installed, and a rotatable caster 13 is mounted to a caster support 14.

The main body 20 is supported by a chassis, not shown, and various units are loaded therein and covered by an outer case 21. In addition, as shown in FIG. 2, a roll operating mechanism 30, a carriage operating mechanism 40 and a paper feeding mechanism 50 are installed to the main body 20 as an operating system using a DC motor.

The roll operating mechanism 30 is installed to a roll loading unit 22 of the main body 20. The roll loading unit 22 is installed to a rear side and an upper side of the main body 20 as shown in FIG. 1 and opens an opening/closing cover 23 which is an element of the outer case 21 described above, and a roll body RP is loaded in the roll loading unit 22 so that the roll body RP may be rotated by the roll operating mechanism 30.

The roll operating mechanism 30 for rotating the roll body RP includes a rotating holder 31, a gear train 32, a roll motor 33, and a rotation detecting unit 34, as shown in FIGS. 2 and 3.

The rotating holder 31 (corresponding to the first roller) is inserted from both end sides of a hollow hole RP1 formed in the roll body RP, and a pair of rotating holders 31 is installed to rotatably retain the roll body RP from both end sides. In addition, in this embodiment, at a rotating holder 31*a* located at one end between one pair of rotating holders 31, a gear is installed as shown in FIG. 3. In addition, as shown in FIG. 3, after the roll body RP is mounted to the rotating holder 31 (31*a*), the roll body RP is inserted to the roll loading unit 22 from above so that the roll body RP is set. By using this configuration, the roll body RP may be easily loaded, and the mounting portion need not be slid laterally when the roll body RP is loaded, which may reduce the space used.

The roll motor 33 gives a driving force (a rotating force) via the gear train 32 to the rotating holder 31*a* to which a gear is installed, between one pair of rotating holders 31. In other words, the roll motor 33 corresponds to the first motor which rotates the rotating holder 31 (and the roll body RP). In addition, in this embodiment, in a case where the roll motor 33 rotates in one direction (specifically in a direction along which the paper P drawn out from the roll body RP is rolled out), the gear of the gear train 32 may be securely engaged with the gear of the rotating holder 31*a* so that the driving force of the roll motor 33 may be transferred to the rotating holder 31*a*, as described later.

The rotation detecting unit 34 uses a rotary encoder in this embodiment. For this reason, the rotation detecting unit 34 includes a disk-like scale 34*a* and a rotary sensor 34*b*. The disk-like scale 34*a* has a light transmitting portion for transmitting light and a light shielding portion for shielding light at regular time intervals in a circumferential direction. In addition, the rotary sensor 34*b* includes a light emitting element not shown, a light receiving element not shown likewise, and a signal processing circuit not shown likewise, as main components. In addition, the rotation detecting unit 34 detects a rotation amount of the roll motor 33 based on the output signal of the rotary sensor 34*b* when the roll motor 33 is rotating.

The carriage operating mechanism 40 includes a carriage 41 and a carriage shaft 42, which are components of an ink supplying/ejecting unit, and also includes a carriage motor, a belt and the like, not shown.

The carriage 41 has an ink tank 43 for storing an ink of each color, and an ink may be supplied to the ink tank 43 via a tube, not shown, from an ink cartridge (not shown) fixedly installed to the front side of the main body 20. In addition, as shown in FIG. 2, a print head 44 capable of ejecting ink droplets is installed to the lower surface of the carriage 41. A nozzle row, not shown, is installed to the print head 44 corresponding to each ink. A piezo-element, not shown, is arranged to each nozzle of the nozzle row. By the operation of the piezo-element, ink droplets may be ejected from the nozzles at the end portion of the ink passage.

In addition, the ink supplying/ejecting mechanism is configured with the carriage 41, the ink tank 43, the tube, not shown, the ink cartridge, not shown, and the print head 44. Moreover, the print head 44 is not limited to the piezo-operating mode using a piezo-element, but a heater mode in which an ink is heated by a heater and uses the force of generated foam, a magnetostrictive mode using a magnetostrictive element, and a mist mode in which mist is controlled in an electric field may be used. In addition, the ink filled in the ink cartridge/ink tank 43 may be any kind of ink such as dye-based inks and pigment-based inks.

Figure 4:
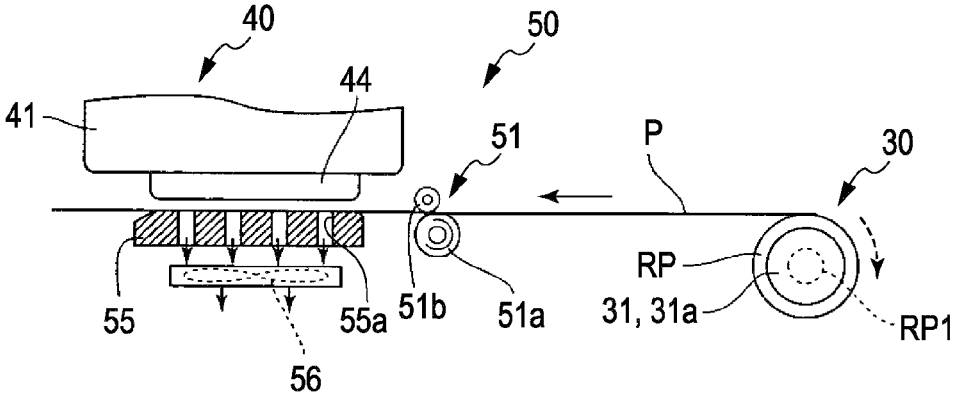
FIG. 4 shows location relations among the roll body, a feeding roller pair and a print head.

The paper feeding mechanism 50 includes a feeding roller pair 51, a gear train 52, a PF motor 53 and a rotation detecting unit 54 as shown in FIGS. 2 and 4. In addition, FIG. 4 shows location relations among the roll body RP, the feeding roller pair 51 and the print head 44.

The feeding roller pair 51 has a feeding roller 51*a* (corresponding to the second roller) and a feeding driven roller 51*b* between which a paper P (roll paper) drawn out from the roll body RP may be nipped.

In addition, in this embodiment, a SMAP (Surface Manufacture Achieved by Powder-in-paint: powder painting) roller is used as the feeding roller 51*a*. Because the SMAP roller is formed of an alumina particle film on the surface of a metal shaft (SMAP shaft) so that the change in the dimensions caused by the change of temperature is small, and the frictional coefficient is stable (in other words, there is feeding stability) since alumina particles are stuck to and carried with the paper. Further, deterioration influenced by disturbance such as back tension is small.

The PF motor 53 gives a driving force (rotating force) to the feeding roller 51*a* via the gear train 52. In other words, the PF motor 53 corresponds to the second motor which rotates the feeding roller 51*a*.

The rotation detecting unit 54 uses a rotary encoder similar to the rotation detecting unit 34 described above and includes a disk-like scale 54*a* and a rotary sensor 54*b*. In addition, similar to the rotation detecting unit 34, the rotation detecting unit 54 detects a rotation amount of the PF motor 53 based on the output signal of the rotary sensor 54*b* when the PF motor 53 is rotating.

In addition, a platen 55 is installed further to the downstream side (discharging side) of the feeding roller pair 51 so that the paper P is guided on the platen 55. Moreover, the print head 44 is installed to the platen 55 to face the platen 55. A suction hole 55*a* is formed in the platen 55. Meanwhile, the suction hole 55*a* is formed to communicate with a suction fan 56 so that air is sucked in through the suction hole 55*a* from the print head 44 by operating the suction fan 56. By doing so, in a case where a paper P is present on the platen 55, it is possible to suck in and maintain the corresponding paper P. In addition, the printer 10 additionally has various other sensors such as a paper width detection sensor for detecting the width of the paper P.

Controller

Figure 5:
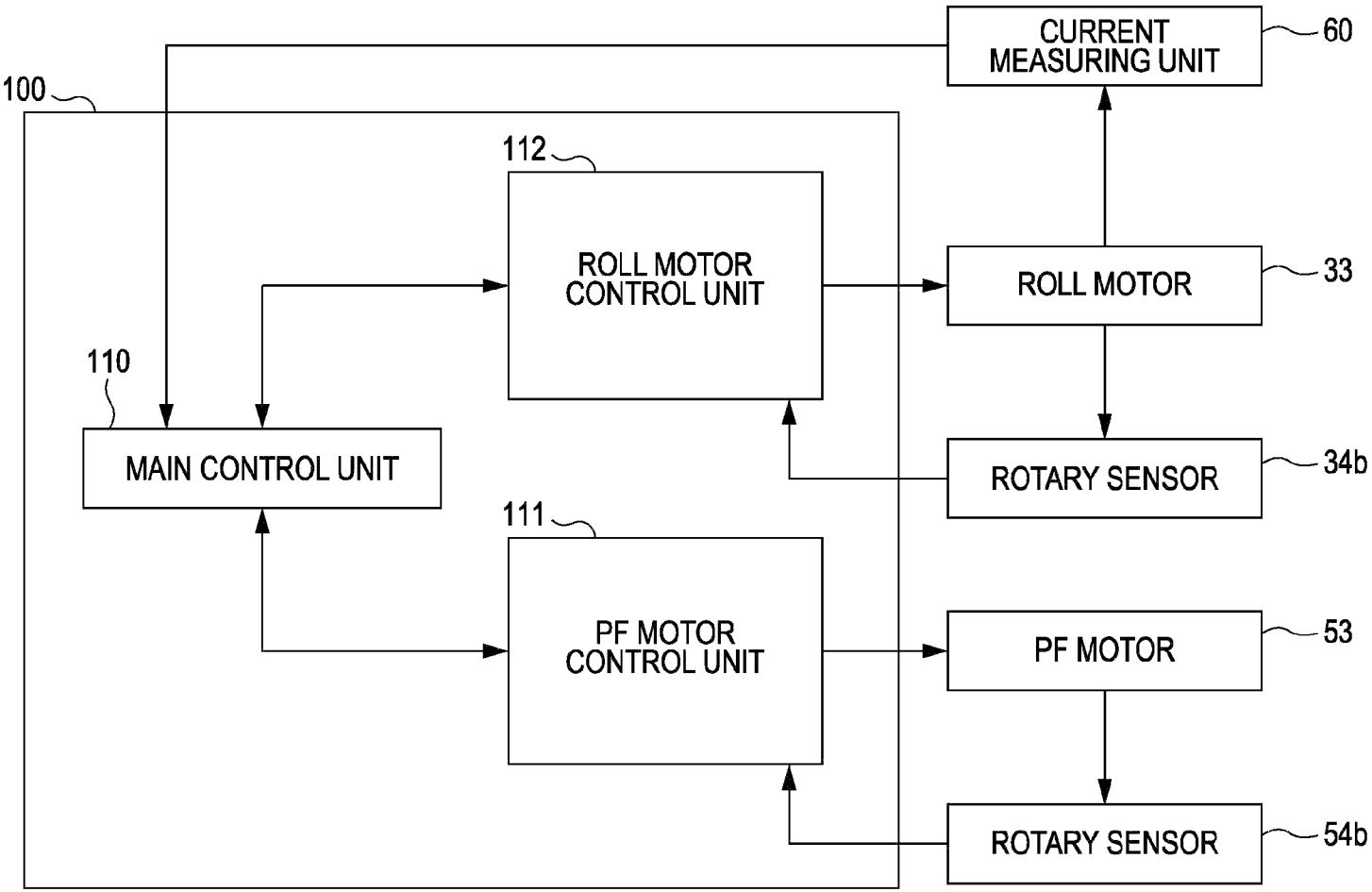
FIG. 5 is a block diagram showing an example of a functional configuration of a controller.

FIG. 5 is a block diagram showing an example of a function configuration of the controller 100. Various output signals of the rotary sensor 34*b* and 54*b*, a linear sensor not shown, a paper width detection sensor not shown, a gap detection sensor not shown, a power switch for turning on/off the printer 10 are input to the controller 100. In addition, the printer 10 of this embodiment has a current measuring unit 60 for measuring the current flowing through the roll motor 33 as shown in FIG. 5 so that a measured value (current value) of the current measuring unit 60 is input to the controller 100.

As shown in FIG. 2, the controller 100 includes a CPU 101, a ROM 102, a RAM 103, a PROM 104, an ASIC 105, a motor driver 106 and the like which are connected to each other via transmission paths 107 such as buses. In addition, the controller 100 is connected to a computer COM. Moreover, the controller 100 executes various kinds of controls as follows by cooperation between the above hardware and software or data stored in the ROM 102 or the PROM 104.

First, the controller 100 controls the operation of the PF motor 53 based on the output of the rotary sensor 54*b* so that the feeding roller 51*a* is rotated to feed the paper P. In addition, hereinafter, the rotating direction of the PF motor 53 when the paper P is fed in the feeding direction (the direction of a solid line arrow in FIG. 4) is called the forward rotating direction. Meanwhile, the rotating direction of the PF motor 53 when the paper P is fed in the reverse feeding direction opposite to the feeding direction is called the reverse direction.

In addition, the controller 100 controls the operation of the roll motor 33 based on the output of the rotary sensor 34*b* so that the slackness of the paper P may be reduced. In other words, the controller 100 controls the operation of the roll motor 33 so that the roll body RP is rotated to roll the paper P around the roll body RP. When the paper P is rolled around the roll body RP, the roll motor 33 rotates in a direction opposite to the forward rotating direction, and hereinafter this direction is called the reverse direction (winding-up direction). In addition, in this embodiment, in a case where the roll motor 33 rotates in the reverse direction, the driving force of the roll motor 33 may be securely transmitted to the rotating holder 31*a*.

Further, the controller 100 calculates the diameter (radius) of the roll body RP based on the slackness decreasing process (described later).

Printing Process

Next, the printing process will be described.

The printing process is performed by repeating a paper feeding process and a head operating process in turns.

In the paper feeding process, a PF motor control unit 111 of the controller 100 controls the operation of the PF motor 53 so that the feeding roller 51*a* is rotated and the paper P is fed in the feeding direction. When performing each paper feeding process, a length (referred to as a feeding amount ΔLt) of a paper P to be fed is designated, and the operation of the PF motor 53 is controlled to feed the paper P by the corresponding feeding amount ΔLt.

Meanwhile, in the head operating process, in a state in which the paper P is stopped, as the print head 44 is scanning in a direction orthogonal to the feeding direction of the paper P, ink droplets are discharged from a plurality of nozzles installed to the print head 44. By doing so, ink dots may be formed on the paper P.

By repeating the above paper feeding process and the head operating process in turns, ink dots may be arranged 2-dimensionally so that a planar image may be printed on the paper P.

In addition, in this embodiment, the diameter of the roll body RP is calculated as described above. By calculating the diameter of the roll body RP, it is possible to calculate a remaining amount of the paper P of the roll body RP in printing, to control a constant load (torque), and to control tension.

Hereinafter, a method for calculating the diameter of the roll body RP will be described.

Method for Calculating Diameter of Roll Body RP Reference Example

In this reference example, the rotating holder 31 (31*a*) is engaged with the roll motor 33 (by gear engagement) to rotate either in the forward rotating direction or in the reverse direction.

In a state of FIG. 4 if the PF motor 53 is operated in the forward rotating direction, the paper P of the roll body RP is fed in the feeding direction (the solid line arrow direction) corresponding to the operation of the PF motor 53, and therefore the roll body RP and the roll motor 33 are also driven to rotate in the forward rotating direction.

Assuming that slackness or slip of the paper P is negligible, it could be considered that the feeding amount (referred to as ΔLpf) of the paper P fed by the rotation of the PF motor 53 is equal to the feeding amount (referred to as ΔLrr) of the paper P fed by the rotation of the roll motor 33.

In addition, the feeding amount ΔLpf and the feeding amount ΔLrr of the paper P are respectively proportional to the counter number Err and Epf by a rotary sensor 34*b* and 54*b*.

Assuming that these proportional coefficients are k1 and k2, the following equations (1) to (3) are established.

$$\Delta Lpf = k1 \times Epf \quad (1)$$

$$\Delta Lrr = k2 \times Err \quad (2)$$

$$\Delta Lpf = \Delta Lrr \quad (3)$$

The proportional coefficient k1 relating to the PF motor 53 is an integer corresponding to a reduction ratio of the gear train 52 or the diameter or pi of the feeding roller 51*a*. Meanwhile, the diameter D (radius r) of the roll body RP decreases in accordance to the feeding of the paper P, and therefore the proportional coefficient k2 relating the roll motor 33 is a coefficient proportional to the diameter (diameter D or radius r) of the roll body RP. If the proportional coefficient k2 is divided by the integer k3 (integer corresponding to the pi or the reduction ratio of the gear train 52) and the diameter D, the above equations may be expressed as follows.

$$\Delta Lrr=k3\times D\times Err \quad (4)$$

$$k1\times Epf=k3\times D\times Err \quad (5)$$

Since k1 and k3 are given integers, if the equation (5) is solved with respect to the diameter D, the diameter D or radius r (=D/2) may be calculated from the count number, Err and Epf.

Embodiment

In this embodiment, as described above, in a case where the roll motor 33 rotates in the reverse direction (in the winding-up direction of the roll body RP), the driving force of the roll motor 33 is transmitted to the roll body RP. In other words, in a case where the PF motor 53 is rotated in the forward rotating direction similar to the reference example, the roll motor 33 is not necessarily limited to rotating (in the forward rotating direction). Therefore, in the calculating method of the reference example, the diameter of the roll body may not be exactly calculated. In addition, since the reference example assumes that there is no slackness, the diameter of the roll body may not be exactly calculated if slackness occurs.

Therefore, in this embodiment, as described below, the PF motor 53 is rotated in the reverse direction so that the paper P becomes intentionally slackened between the feeding roller 51*a* and the roll body RP, and then the roll motor 33 is rotated in the reverse direction. By doing so, the slackness of the paper P between the feeding roller 51*a* and the roll body RP may be resolved, and also the diameter of the roll body RP is calculated. By doing so, the diameter of the roll body RP may be calculated very precisely. In addition, since the diameter of the roll body RP may be calculated very precisely, the precision of tension control may be improved.

Figure 6:
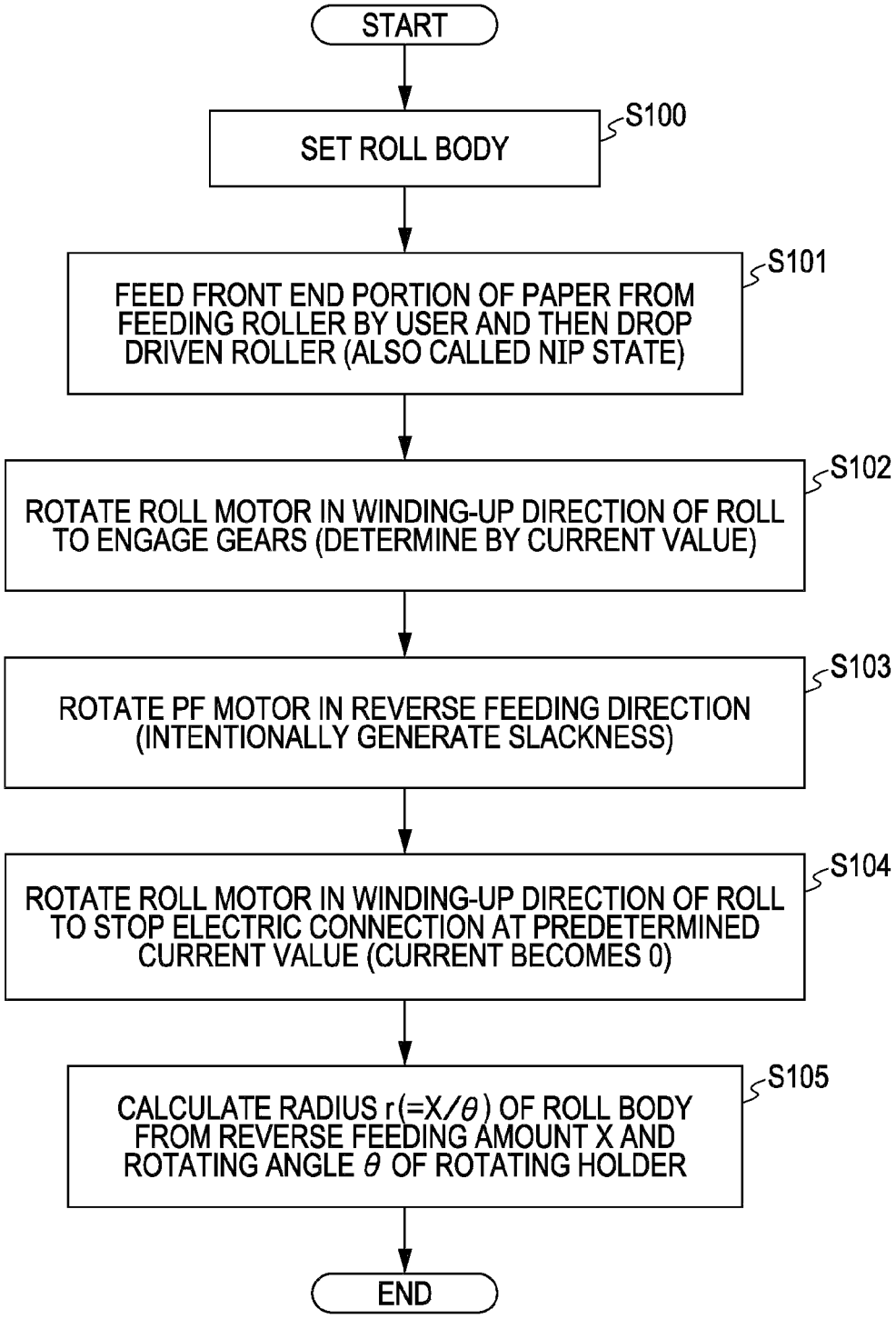
FIG. 6 is a flowchart illustrating an operation for calculating a roll diameter.

FIG. 6 is a flowchart illustrating a process of calculating the diameter of the roll body RP according to this embodiment. Here, the case of calculating the diameter of the roll body RP when the roll body RP is exchanged will be described.

First, the controller 100 detects whether the roll body RP is loaded (set) to the roll loading unit 22 (S100). For example, a sensor, not shown, may be used for detecting whether the roll body RP is loaded to the roll loading unit 22, and it may be detected whether the roll body RP is loaded in response to the manipulation of a manipulation panel, not shown. After the roll body RP is loaded, the front end portion of the paper P which has been rolled on the roll body RP is drawn out by a user to pass between the feeding roller 51*a* and the feeding driven roller 51*b*. In addition, in order to set the roll body RP as described above, the feeding driven roller 51*b* is spaced apart from the feeding roller 51*a*. Thereafter, the controller 100 drops (moves) the feeding driven roller 51*b* onto the feeding roller 51*a* in response to the manipulation of a manipulation panel, not shown, so that the paper P is nipped between the feeding roller 51*a* and the feeding driven roller 51*b* (which is also called NIP state) (S101).

In the NIP state, the controller 100 rotates the roll motor 33 in the winding-up direction (the direction of a dotted line arrow in FIG. 4) of the roll body RP so that the gear of the rotating holder 31*a* is engaged with the gear of the gear train 32 (S102). In addition, it is determined whether the gear of the rotating holder 31*a* is engaged with the gear of the gear train 32 by checking that the measured value of the current measuring unit 60 which measures current of the roll motor 33 becomes a predetermined current value (described later). By doing so, even in a case where the paper P between the roll body RP and the feeding roller 51*a* is slack, after the gears are engaged with each other, the slackness of the paper P is resolved so that a predetermined tension is applied thereto.

Next, the controller 100 rotates the feeding roller 51*a* in the reverse direction by the PF motor 53 so that the paper P is fed as much as a predetermined feeding amount (referred to as X) in the reverse feeding direction (S103). In other words, the paper P between the roll body RP and the feeding roller 51*a* is intentionally slackened.

Thereafter, the controller 100 rotates the rotating holder 31*a* in the reverse direction (in the winding-up direction) by the roll motor 33. By doing so, the slackness of the paper P generated in the step S103 gradually decreases. In addition, if the measured value of the current measuring unit 60 reaches a predetermined current value, the controller 100 determines that the slackness of the paper P is resolved and controls the current value flowing through the roll motor 33 to be zero (S104). In addition, the predetermined current value represents a current value when a high load occurs since the slackness is resolved so that the roll motor 33 cannot rotate the roll body RP, for example a current value corresponding to 1.5 times of the mechanical load. In other words, it may be determined that the slackness of the paper P is resolved if the current value of the roll motor 33 becomes the predetermined current value.

In addition, in this embodiment, after the slackness of the paper P is resolved, the current value flowing through the roll motor 33 is set to zero. By doing so, it is possible to prevent the gear of the rotating holder 31*a* and the gear of the gear train 32 from distorting, which allows power consumption to be reduced.

In addition, the controller 100 calculates the diameter (radius) r of the roll body RP based on the reverse feeding amount X of the paper P and the rotating angle of the rotating holder 31*a* (S105). Moreover, the rotating angle of the roll body (the rotating holder 31*a*) in the step S104 is calculated based on the detection result of the rotation amount of the roll motor 33 by the rotation detecting unit 34.

Assuming that the rotating angle of the rotating holder 31*a* is θ(rad), when the measured value of the current measuring unit 60 becomes a predetermined current value (when the slackness is resolved), the following relation is established.

$$X=r\times\theta \quad (6)$$

From the equation (6):

$$r=X/\theta \quad (7)$$

The reverse feeding amount X of the paper P is calculated based on the rotation amount of the PF motor 53, and the rotating angle θ of the rotating holder 31*a* is calculated based on the rotation amount of the roll motor 33. As mentioned above, since both of the reverse feeding amount X and the rotating angle θ are obtained, the radius r of the roll body RP may be calculated using the equation (7).

As described above, the printer 10 of this embodiment includes the rotating holder 31 (31*a*) for rotatably retaining the roll body RP where the paper P is rolled, the roll motor 33 for rotating the rotating holder 31, the feeding roller 51*a* installed further to the downstream side of the roll body RP in the feeding direction of the paper P to feed the medium in the feeding direction or in a reverse feeding direction corresponding to the rotating direction, and the PF motor 53 for rotating the feeding roller.

In addition, the controller 100 of the printer 10 reversely feeds the paper P by a reverse feeding amount X in the reverse feeding direction by the PF motor 53 to cause the paper P between the rotating holder 31 and the feeding roller 51*a* to be slack, and then rotates the roll body RP in the winding-up direction by the roll motor 33 so that the slackness decreases. In addition, the controller 100 calculates the radius r of the roll body RP by the equation of $r=X/\theta$ from the rotation amount $\theta$ of the rotating holder 31 and the feeding amount X at that time.

As described above, in this embodiment, by using the slackness decreasing operation, the diameter of the roll body RP may be precisely calculated with a simple configuration.

In addition, in this embodiment, whether the slackness of the paper P is resolved or not is determined, based on the current value flowing through the roll motor 33 becoming a predetermined current value. By doing so, the timing when the slackness of the paper P is resolved may be exactly obtained.

In addition, in this embodiment, after the slackness is resolved, the current value flowing through the roll motor 33 is set to zero. By doing so, the reduction of power consumption may be promoted.

Other Embodiments

Though a printer or the like is described as one embodiment, the above embodiment is just for easy understanding of the invention and is not intended to limit the scope of the invention. The invention can be changed or modified without departing from the spirit thereof, and it is obvious that equivalents are included in the invention. In particular, the following embodiments are also included in the invention.

In the above embodiment, the printer 10 has been described as a printing device. However, the printing device is not limited to the printer 10, but a facsimile using a roll body (roll paper) may also be used. In addition, though the paper P is a roll paper in the above embodiment, a film-shaped member, a resin-based sheet, an aluminum foil or the like may also be used instead of the paper P.

In addition, the printer 10 of the above embodiment may be a part of a complicated machine such as a scanner machine or a copy machine. Further, in the above embodiment, the ink jet type printer 10 has been described. However, the printer 10 is not limited to an ink jet type printer. For example, the embodiment may be applied to various kinds of printers such as a gel jet printer, a toner-type printer, and a dot impact printer.

In addition, the controller 100 is not limited to the above embodiment, it is possible that only ASIC 105 controls the roll motor 33 and the PF motor 53, and 1-chip microcomputer where various peripherals are built in may be combined to configure the controller 100.

Timing for Calculating Roll Diameter

Though the diameter of the roll body RP is calculated when the roll body RP is set (exchanged) in the above embodiment, the timing for calculating the diameter of the roll body RP is not limited thereto. For example, the diameter may be calculated whenever printing is performed to the roll body RP.

In detail, the steps S102 to S105 of FIG. 6 may be executed before the printing process is performed to the roll body RP. By doing so, the diameter of the roll body RP may be checked at every printing, and it is possible to calculate a remaining amount of the roll body RP, to calculate a constant load, and to control tension in a suitable way based on the diameter of the roll body RP.

In addition, it is also possible to calculate the diameter of the roll body RP not before printing but after printing so that the calculated value may be used at the next printing.

Determining Whether Slackness is Resolved

Though whether the slackness of the paper P is resolved or not in the step S104 of FIG. 6 in the above embodiment is determined based on the measured value of the current measuring unit 60, the invention is not limited thereto. For example, the determination may be performed visually. However, by determining based on the measured value of the current measuring unit 60 as in the above embodiment, the precision of the calculated diameter of the roll body RP may be improved further.

What is claimed is:

1. A printing device comprising:

a first roller that rotatably retains a roll body where a medium is rolled;

a first motor that rotates the first roller;

a second roller that is installed downstream of the roll body in a feeding direction of the medium to feed the medium in the feeding direction or in a reverse feeding direction which is opposite to the feeding direction;

a second motor that rotates the second roller; and a controller that causes the medium to become slack between the first roller and the second roller by feeding the medium by a predetermined feeding amount in the reverse feeding direction by the second motor while keeping the first roller stationary such that the medium is intentionally slackened between the first roller and the second roller, and then rotates the roll body in a winding-up direction by the first motor while keeping the second roller stationary so that the slack between the first roller and the second roller is resolved to calculate a diameter of the roll body based on the rotation amount of the first roller at that time and the predetermined feeding amount.

2. The printing device according to claim 1, further comprising a current measuring unit that measures a current value flowing through the first motor, wherein the controller determines that the slack between the first roller and the second roller is resolved when a measured value of the current measuring unit becomes a predetermined current value.

3. The printing device according to claim 2, wherein the controller sets a current value flowing through the first motor to zero after the measured value of the current measuring unit becomes the predetermined current value.

4. A roll diameter calculating method of a printing device which includes a first roller for rotatably retaining a roll body where a medium is rolled; a first motor for rotating the first roller; a second roller installed further to a downstream side of the roll body in a feeding direction of the medium to feed the medium in the feeding direction or in a reverse feeding direction which is opposite to the feeding direction; and a second motor for rotating the second roller, the method comprising:

feeding the medium by a predetermined feeding amount in the reverse feeding direction by the second motor while keeping the first roller stationary so that the medium is intentionally slackened between the first roller and the second roller;

after said feeding, rotating the roll body in a winding-up direction by the first motor while keeping the second roller stationary so that the slack between the first roller and the second roller is resolved; and calculating a diameter of the roll body based on the rotation amount of the first roller during said rotating in the winding-up direction and the predetermined feeding amount.

5. A non-transitory computer-readable storage medium having a program stored thereon, the program causing a controller of a printing device which includes a first roller for rotatably retaining a roll body where a medium is rolled; a first motor for rotating the first roller; a second roller installed further to a downstream side of the roll body in a feeding direction of the medium to feed the medium in the feeding direction or in a reverse feeding direction which is opposite to the feeding direction; and a second motor for rotating the second roller, to execute the following functions:

feeding the medium by a predetermined feeding amount in the reverse feeding direction by the second motor while keeping the first roller stationary so that the medium is intentionally slackened between the first roller and the second roller;

after said feeding, rotating the roll body in a winding-up direction by the first motor while keeping the second roller stationary so that the slack between the first roller and the second roller is resolved; and calculating a diameter of the roll body based on the rotation amount of the first roller during said rotating in the winding-up direction and the predetermined feeding amount.

* * * * *